US012624406B2

(12) United States Patent
Simmons et al.

(10) Patent No.: US 12,624,406 B2
(45) Date of Patent: May 12, 2026

(54) PROCESS AND SYSTEM FOR THE PRODUCTION OF IRON NUGGETS

(71) Applicant: Carbontec Energy Corporation, Bismarck, ND (US)

(72) Inventors: John Simmons, Bismarck, ND (US); Dale Hintsala, Nashwauk, MN (US)

(73) Assignee: Carbontec Energy Corporation, Bismarck, ND (US)

( * ) Notice: Subject to any disclaimer, the term of this patent is extended or adjusted under 35 U.S.C. 154(b) by 0 days.

(21) Appl. No.: 17/759,805

(22) PCT Filed: Mar. 23, 2022

(86) PCT No.: PCT/US2022/021584
§ 371 (c)(1),
(2) Date: Jul. 29, 2022

(87) PCT Pub. No.: WO2022/204307
PCT Pub. Date: Sep. 29, 2022

(65) Prior Publication Data

US 2024/0182993 A1 Jun. 6, 2024

Related U.S. Application Data

(60) Provisional application No. 63/164,924, filed on Mar. 23, 2021.

(51) Int. Cl.

| | |
|---|---|
| ***C21B 13/00*** | (2006.01) |
| ***C21B 13/10*** | (2006.01) |
| ***C21C 1/10*** | (2006.01) |

(52) U.S. Cl.
CPC ..... *C21B 13/0046* (2013.01); *C21B 13/10* (2013.01); *C21C 1/10* (2013.01); *C21B 2400/032* (2018.08)

(58) Field of Classification Search
None
See application file for complete search history.

(56) References Cited

U.S. PATENT DOCUMENTS

| | | | |
|---|---|---|---|
| 6,592,649 | B2 | 7/2003 | Kikuchi et al. |
| 7,632,330 | B2 | 12/2009 | Eisele et al. |

(Continued)

OTHER PUBLICATIONS

Natural Vs. Synthetic graphite (Year: 2014).*

(Continued)

*Primary Examiner* — Jenny R Wu
(74) *Attorney, Agent, or Firm* — DeWitt LLP

(57) ABSTRACT

A hearth for a traveling hearth furnace for the production of pig iron grade nuggets, the hearth having a synthetic graphite material in direct contact with the process charge in producing a plurality of metallic iron nodules and slag. The process charge including iron containing oxide, a predetermined amount of a reductant and flux, which are carried into and through a reducing, melting and coalescing stages on the hearth, wherein resulting metallic iron nodules and slag are in direct contact with the synthetic graphite material and do not adhere to the synthetic graphite material of the hearth. The absence adherence and ease of removal minimizes any impurities in the pig iron grade nuggets and allows the hearth to be used more than one cycle without the need for any replenishment of the contact surface.

15 Claims, 3 Drawing Sheets

(56) References Cited

U.S. PATENT DOCUMENTS

| | | | | |
|---|---|---|---|---|
| 8,906,131 | B2 | 12/2014 | Simmons | |
| 2003/0097908 | A1 | 5/2003 | Hoffman et al. | |
| 2006/0150774 | A1* | 7/2006 | Iwasaki | F27B 9/12 75/503 |
| 2011/0100162 | A1* | 5/2011 | Iwasaki | C22B 5/10 75/503 |
| 2012/0160060 | A1 | 6/2012 | Iwasaki | |
| 2012/0198966 | A1 | 8/2012 | Kiesel et al. | |

OTHER PUBLICATIONS

Pig Iron: A guide for transporting and Handling at Terminals International Iron Metallics Association (Year: 2014).*
Carbon Blocks for Blast Furnace Hearth refractories Nippon steel Technical Report No. 125 (Year: 2020).*
International Search Report and Written Opinion for PCT/US2022/021584 date mailed Jul. 26, 2022.

* cited by examiner

PROCESS AND SYSTEM FOR THE PRODUCTION OF IRON NUGGETS

PRIORITY CLAIM

This is a U.S. National Stage Application filing under 35 U.S.C. 37 of International Application No. PCT/US2022/021584, filed Mar. 23, 2022, which claims the benefit of U.S. Provisional Application No. 63/164,924, filed Mar. 23, 2021, each of which is hereby incorporated by reference in its entirety.

TECHNICAL FIELD

This invention relates to the production of pig iron grade nuggets. More specifically, the present invention is directed to the production of pig iron grade nuggets in traveling hearth furnaces by providing a hearth having synthetic graphite in direct contact with the process charge.

BACKGROUND

Currently, the most commonly used process for the production of pig iron is carried out in a blast furnace. It is well recognized that production of pig iron in that manner is a major contributor to the emission of unwanted gases into the atmosphere, particularly carbon dioxide. For that reason the iron and steel industry has moved in the direction of reducing the use of blast furnaces worldwide. In spite of that effort, virtually all merchant pig iron is still produced in a blast furnace. Merchant pig iron is defined as cold pig iron cast into ingots, granulated, or produced in the form of nuggets that are produced and sold on the market to third party users as ferrous feedstock, such as foundries and electric furnace steel makers, and to integrated steel making operations, which cannot produce sufficient pig iron to satisfy its requirement. In contrast to merchant pig iron produced in a blast furnace, pig iron grade nuggets can be produced in a traveling hearth furnace consuming 30% less energy or more and reducing carbon dioxide emissions.

In a traveling hearth furnace, a hearth is moved into and through a reducing furnace carrying a mixture of a reductant, fluxes and iron containing oxides, e.g. iron ore and/or iron containing waste oxides from blast furnace or steel making operations. Currently, basically all merchant pig iron is produced in blast or shaft furnaces and little, if any, produced in hearth furnaces, i.e. linear (tunnel) or rotary hearth furnaces. That is believed to be the result of the complexity and cost of doing so in a traveling hearth furnace U.S. Pat. No. 7,695,544 contains a discussion of the state of the art relative to pig iron grade iron nugget production in a traveling hearth furnace. As disclosed therein, a hearth made from refractory material or has refractory material applied on the surface thereof carries a process charge, which comprises a mixture of a reductant, flux and iron containing oxides (e.g. iron ore), and is moved into, through and/out of a reducing and melting furnace. In the furnace, the process charge goes through drying, preheating, reduction, melting, and coalescence stages to convert the process charge into pig iron grade nuggets or nodules and slag. The disclosure contained in U.S. Pat. No. 7,695,544 is incorporated herein by reference in its entirety.

In the prior art, the process charge of a traveling hearth furnace can be in the form of a pellet, briquette or like, carried on a hearth bed into and out of a reducing and melting environment generated in the furnace. As discussed in U.S. Pat. No. 7,695,544, the accepted conventional method is to provide a layer of carbonaceous material (a hearth layer) on the hearth to separate the process charge from the hearth surface.

U.S. Pat. No. 7,695,544 teaches that the hearth layer provides separation of the process charge and the molten iron and slag from hearth bed to prevent the nuggets/nodules and slag from engaging the hearth surface. That separation prevents the molten iron and slag from reacting with the hearth to create an interface there between that would cause the solidified nuggets and/or the slag to adhere to the hearth. Such an adherence interferes with the removal of the metallic nuggets/slag form from the hearth at the end of the furnace process. The negatives of such an occurrence are (i) the adherence interferes with separating the metallic iron nuggets and slag from the hearth for post reduction processing to have it in the form of a discrete metallic iron nugget, the form useable in follow on iron foundry and steel making process; and (ii) the hearth could be damaged to the extent that it can't be reused in additional reduction cycles. Therefore, not only will part of the production be lost, but the hearth must be replaced, either of which contributing to increasing the cost of the pig iron grade iron nugget production.

It should also be noted that the carbonaceous material as taught in U.S. Pat. No. 7,695,544 is coal, char and/or coke, which adds to the underlying cost of the process and also presents an additional carbon source available for the generation of carbon dioxide and other unwanted gases. The carbonaceous material is also a source of sulfur, the presence of which is to be avoided in steel making process. Sulfur will be absorbed into the produced pig iron grade iron nuggets, which degrades the value of the pig iron for use in the iron foundry and steel making process.

The use of the carbonaceous material hearth layer also adds to the complexity and cost of the process in that special attention is required to ensure that the process material is carried in the hearth layer in a manner that ensures discrete iron nuggets/nodules are produced. In addition, at the completion of the furnace process, it is necessary to separate the metallic iron nuggets and slag from the carbonaceous material hearth layer to get the pig iron grade iron nuggets and slag as discrete clean nuggets, and clean slag as a material useable for road making or other uses.

Therefore, there is a need in the industry in reducing sulfur contamination in pig iron grade nuggets produced using a traveling hearth furnace, as well as deleterious situations and emissions during the reduction process. There is also a need in the industry of simplifying the hearth furnace operation and eliminate the complexity and cost of iron oxide reduction in a hearth furnace. There is further a need in the industry of producing pig iron grade nuggets using a traveling hearth furnace whereby the solidified pig iron grade iron nuggets and/or the slag do not adhere to the hearth, such that metallic iron nuggets and slag can easily be separated from the hearth and any damage to the hearth during the separation is reduced or eliminated to allow reuse of the hearth in additional reduction cycles.

SUMMARY

The present inventors have surprisingly discovered that a hearth having synthetic graphite in direct contact with the process charge has the unique property of being capable of being exposed to high temperatures as those involved in the reduction process in traveling hearth without the synthetic graphite experiencing any change in its physical or chemical properties that could cause interaction between it and the molten pig iron grade iron nuggets or slag, which prevents the nuggets and slag from adhering to the hearth surface. In some aspects, the hearth comprises a substrate material and at least one layer of synthetic graphite proximate the area that the process charge is in direct contact with the hearth. In some aspects, the substrate material of the hearth is at least partially encapsulated in a synthetic graphite layer. In some aspects, the hearth comprises a monolithic synthetic graphite material.

In some aspects, the hearth layer in direct contact with the process charge comprises synthetic graphite and is substantially devoid of traditional carbonaceous material. Accordingly the hearth layer of carbonaceous material is eliminated as is its adverse impact on the overall process.

In some other aspects, the hearth layer in direct contact with the process charge is substantially devoid of natural graphite.

Thus, an uncontaminated pig iron grade iron nuggets, with little or no sulfur in the iron nugget, and with the attached slag is presented at the end of the furnace process ready, without further attention, for the necessary post processing. The iron nugget and slag are easily removed from hearth ready for the final steps of a cooling, including a water quench (if desired), separating the pig iron from the slag (tumbling), and separating the pig iron phase from the slag phase (magnetic separation).

The advantages, or better phrased, the advances to the reduction process in a hearth furnace are that only the iron containing oxides, the reductant, and the fluxes are in the process. The exact stoichiometric amount of carbon necessary for reduction will be used in the process and there will not be any additional source of carbon present to add to emissions that are created. That provides a measure of control over the amount of Carbon dioxide generated and discharged into the atmosphere. Furthermore, there is no residue of carbonaceous material that has to be dealt with at the end of the furnace process.

The above summary is not intended to describe each illustrated embodiment or every implementation of the subject matter hereof. The figures and the detailed description that follow more particularly exemplify various embodiments.

Figure 1:
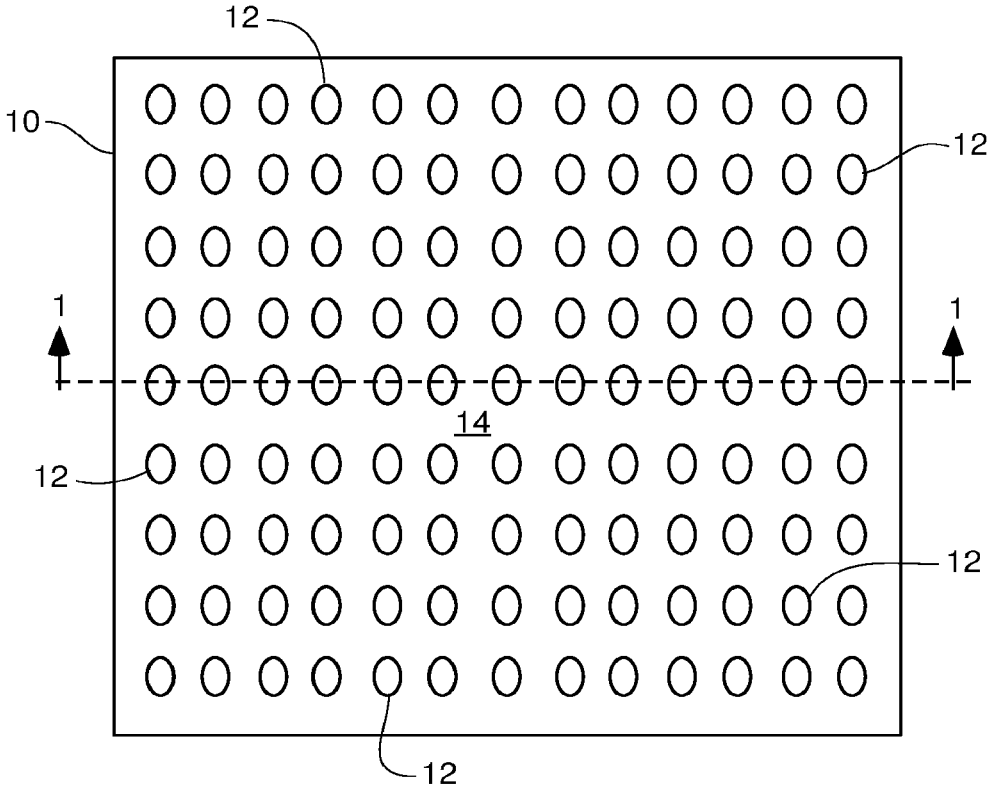
FIG. 1 is a top view illustration of a hearth loaded with the process charge in the form of pellets resting directly on the surface of the hearth, according to certain embodiments of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Representative embodiments of the present disclosure provide a hearth having synthetic graphite in direct contact with the process charge, which prevents the nuggets and slag from adhering to the hearth surface.

The term "synthetic graphite" as referred to herein means a solid graphitic carbon material artificially crystallized by the high-temperature treatment of or chemical deposition of hydrocarbon materials and having a molecular weight of about 12 g/mol, specific gravity between 2.190 and 2.260 g/cm$^3$ and a melting point between 3652° C. and 3697° C. (6606-6687° F.). In some preferred aspects, synthetic graphite capable of achieving the objectives of the present invention is available from Graphite Sales, Inc in Chagrin Falls, Ohio, having an percent ash content of less than 2.0, percent carbon content greater than 98% and a percent sulfur content less than 0.02. The term "natural graphite" as referred to herein means a solid graphitic carbon material that has been mined and has been naturally crystallized by the transformation of carbon-rich organic material under the long-term action of high temperature and high pressure.

The term "carbonaceous material" as referred to herein means carbon-containing material suitable for use as a carbonaceous reductant, such as coal, char and/or coke. One of ordinary skill in the art will appreciate that carbonaceous material used herein does not include natural or synthetic graphite and does not otherwise have a graphite crystal structure.

The synthetic graphite of the hearth can comprise at least one layer of synthetic graphite overlaying a substrate material. In some aspects, the at least one layer of synthetic graphite is bound to the substrate. In some other aspects, the at least one layer of synthetic graphite at least partially encapsulates the substrate. The hearth can also be formed of synthetic graphite, such that the hearth comprises a monolithic synthetic graphite material. The synthetic graphite of the hearth is in direct contact with the process charge, which with a melting temperature of at least 3652° C. (6606° F.) is well above the reduction temperature of 1490° C. (2714° F.) to which it will be exposed in the furnace. That characteristic means that during the furnace process the hearth and more particularly its surface remains in its original state without any chemical or physical changes that could cause the molten iron and slag to adhere to the hearth.

Figure 2:
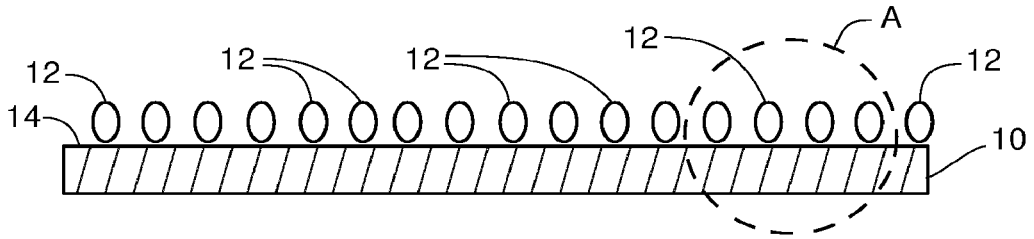
FIG. 2 is a cross-section view of the illustration of the hearth of FIG. 1 along line 1-1, according to certain embodiments of the present invention.

Now referring generally to the figures, FIGS. 1 and 2 show a hearth 10 constructed from the high temperature synthetic graphite. The process charge, in the form of pellets 12, rests directly on the surface 14 of the hearth 10.

Figure 3:
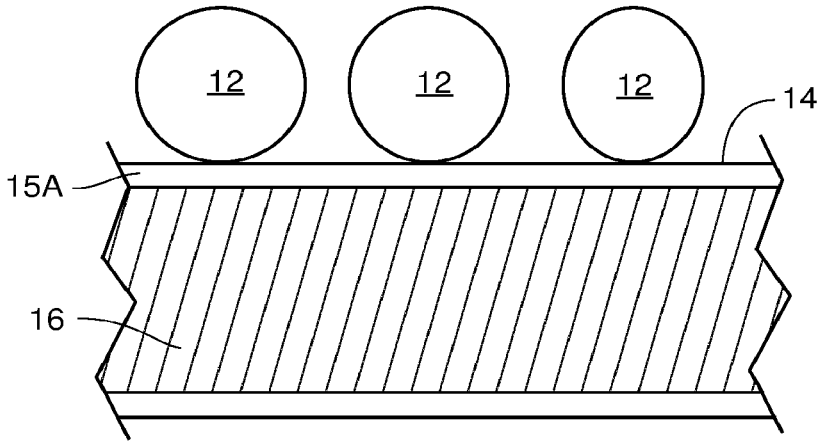
FIG. 3 is an enlarged view of the cross-sectional area A of the hearth of FIG. 2 showing an embodiment of the hearth having a layer of synthetic graphite in direct contact with the process charge, according to certain embodiments of the present invention.

As shown in FIG. 3, which is a blow-up of representative section "A" of FIG. 2, the synthetic graphite in direct contact with the process charge can be at least one layer of synthetic graphite 15 operably attached to a substrate 16. In some aspects, the at least one layer of synthetic graphite 15 is bound to the substrate 16. In some other aspects, the substrate 16 can be at least partially encapsulated by the at least one layer of synthetic graphite 15. Each layer of synthetic graphite can be between about 0.5 mm and about 100 cm, in some aspects between about 1 mm and about 10 cm, in some other aspects between about 2 mm and about 5 cm, and in some other aspects between about 2.5 mm and about 2.5 cm. In some aspects, the synthetic graphite can be provided as two or more layers.

Figure 4:
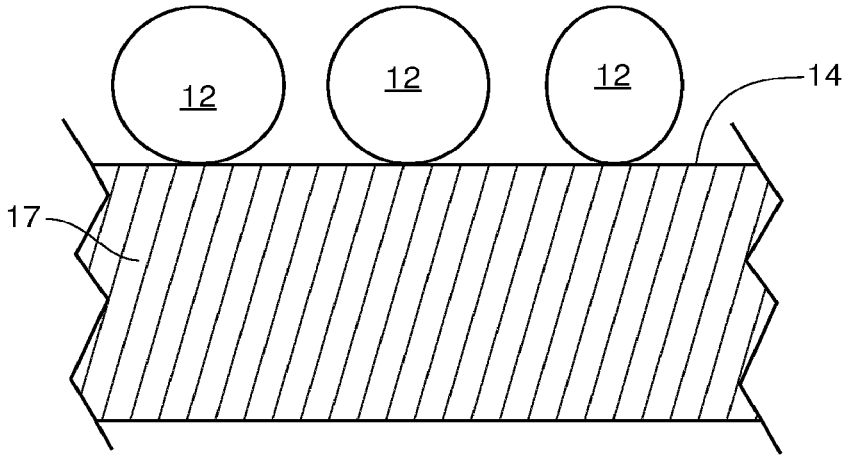
FIG. 4 is an enlarged view of the cross-sectional area A of the hearth of FIG. 2 showing an embodiment of the hearth being a monolithic synthetic graphite material in direct contact with the process charge, according to certain embodiments of the present invention.
Figure 5:
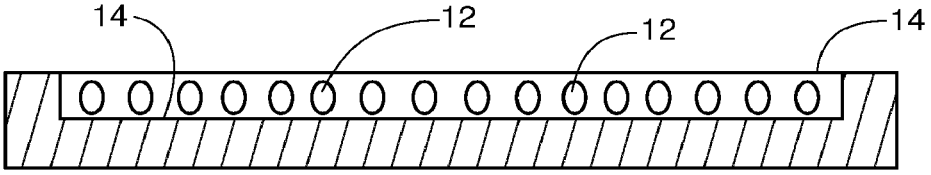
FIG. 5 is a cross-sectional view of a hearth having a raised edge and loaded with the process charge in the form of pellets resting directly on the surface of the hearth, according to certain embodiments of the present invention.

As shown in FIG. 4, which is a blow-up of representative section "A" of FIG. 2, the hearth can comprise a monolithic synthetic graphite material 17, such that the process charge is in direct contact with the synthetic graphite. In some aspects, the monolithic synthetic graphite material 17 has a thickness between about 1 inch and about 12 inches, in some aspects between about 1.5 inches and about 10 inches, and in some other aspects between about 2 inches and about 6 inches.

The pellets are carried on the hearth into and through the furnace where they go through a conventional pre-heat, reduction, melting, coalescence, and finally exiting the furnace as a pig iron grade iron nuggets with attached slag.

After coalescing, the resulting nuggets are allowed to cool down and, if desired can go through a water quench, so that post processing can continue at a lower temperature. Post processing consists of a combination of sweeping and magnetic lifting the iron nuggets from the hearth and moving the nuggets with attached slag into a water bath and then to a tumbler to separate the slag from the pig iron. Once separated the iron nuggets and slag are separated into two products, a pig iron product and a slag product by a magnetic separator. The iron nuggets are then lauded into rail cars, trucks, barges, ships or are inventoried for eventual use or sale and the slag disposed by sales for road building or other purposes or in a conventional manner.

During the above-described process, there will be a time when the iron and slag will be in a molten state. To ensure that while in a molten state the process material remains confined within the hearth, according to certain embodiments, the hearth is formed with a raised edge 14. The raised edge prevents any overflow from the hearth that might otherwise occur.

A linear or tunnel hearth furnace (not shown but disclosed in U.S. Pat. No. 7,695,544) is the preferred furnace. A conventional walking beam (not shown) may be used to move the hearth or hearths through the furnace. As an alternative, the hearths may be moved by pushing a hearth on rails or wheels which in turn pushes the hearth in front of it. More particularly, the hearths as they move through furnace will be aligned in the furnace on a suitable flat support. As an addition hearth is pushed into the alignment it pushes the hearths in front of it and all hearths in the furnace are moved one hearth length. In that manner the hearths are moved through the furnace in a step-by-step fashion. The heath can alternatively include a base made of suitable refractory material with a synthetic graphite layer covering the surface of the base and separating the base surface from the process charge and during the reduction, melting and coalescing stages from the melting and coalescing iron and slag.

By eliminating the need for a carbonaceous hearth layer, the present invention has provided an improved hearth furnace pig iron process. Namely, the hearth of the present invention:

1. Eliminates the carbonaceous hearth layer material and the added cost factors attributable thereto.
2. Eliminates the time-consuming step of configuring the carbonaceous hearth layer to support the process charge in a manner to ensure the production of discrete nuggets.
3. Eliminates the introduction of unwanted elements that are contained in the carbonaceous materials identified above that would produce impurities in the produced pig iron, for example sulfur, and the presence of which is a problem in iron foundries and steel making.
4. As there is no source of carbon other than that contained in the process charge only, the stoichiometric amount necessary for reduction is used providing a measure of control over the amount of carbon dioxide emissions that can be generated is achieved in the course of the reduction process.
5. Eliminates the need for separating the produced pig iron grade iron nuggets from the carbonaceous hearth layer at the end of the furnace process to prepare the product from the furnace for necessary post processing, i.e. physically separate the iron nuggets from the slag and into discrete products or phases.
6. No need to replenish the carbonaceous material making up hearth layer that was consumed in the furnace process.
7. Ensures that a hearth can be used for more than a limited number of cycles.

The preferred reductant, consistent with being environmentally positive, is a suitable biomass.

In some aspects, the resulting nuggets contain a sulfur impurity in an amount less than about 200 ppm, preferably less than about 190 ppm, preferably less than about 180 ppm, preferably less than about 170 ppm, preferably less than about 160 ppm, preferably less than about 150 ppm, preferably less than about 140 ppm, preferably less than about 130 ppm, preferably less than about 120 ppm, preferably less than about 110 ppm, preferably less than about 100 ppm, preferably less than about 90 ppm, preferably less than about 80 ppm, preferably less than about 70 ppm, preferably less than about 60 ppm, preferably less than about 50 ppm, preferably less than about 40 ppm, preferably less than about 30 ppm, preferably less than about 20 ppm, and more preferably less than about 10 ppm.

With regard to the environmental aspects of the present invention, the elimination of the carbonaceous hearth layer allows the technology disclosed in of U.S. Pat. Nos. 7,632,330 and 8,906,131 in addition to the protective carbonaceous layer to be in combination with the technology of the invention of this application for an even more environmentally enhanced and cost effective pig iron grade iron nugget production process. Accordingly, the disclosures contained in U.S. Pat. Nos. 7,632,330 and 8,906,131 are incorporated herein by reference as if set forth herein in its entirety as part of this provisional application In the final analysis this invention makes available an improved and cost affective process that can produce merchant pig iron grade iron other than in a blast or shaft furnace and in a far more environmentally sound manner.

What is claimed is:

1. A process for reducing iron containing oxides to produce a plurality of metallic iron nodules from a process charge including iron containing oxide, a predetermined amount of a reductant and flux, wherein the process charge is carried into a traveling hearth furnace for reducing, melting and coalescing stages to convert the process charge into the plurality of metallic iron nodules and slag components, the process comprising:

providing a process charge on a hearth configured to be moved into and through the traveling hearth furnace, the hearth comprising a synthetic graphite material, wherein the process charge is in direct contact with an outer surface of the hearth consisting of the synthetic graphite material, such that the outer surface of the hearth is substantially devoid of a separate layer of carbonaceous material and natural graphite; and carrying the process charge on the hearth within the traveling hearth furnace during the reducing, melting and coalescing stages, wherein the process charge is in direct contact with the synthetic graphite material such that the plurality of metallic iron nodules and slag components are only in direct contact with the synthetic graphite material of the hearth, and wherein each of the plurality of metallic iron nodules contain a sulfur impurity level in an amount less than about 200 ppm.

2. The process of claim 1, wherein the synthetic graphite material has a thickness between about 2 mm and about 5 cm.

3. The process of claim 1, wherein the synthetic graphite material is configured as two or more layers forming the outer surface of the hearth.

4. The process of claim 1, wherein the hearth comprises a monolithic synthetic graphite material.

5. The process of claim 4, wherein the monolithic synthetic graphite material has a thickness between about 1 inch and about 12 inches.

6. The process of claim 1, wherein the plurality of metallic iron nodules and slag components do not adhere to the synthetic graphite material.

7. The process of claim 1, wherein the hearth is devoid of any carbonaceous material in direct contact with the process charge.

8. The process of claim 1, wherein the hearth is devoid of any natural graphite material in direct contact with the process charge.

9. The process of claim 1, wherein the sulfur impurity level of each of the plurality of metallic iron nodules in an amount less than about 80 ppm.

10. The process of claim 1, wherein the plurality of metallic iron nodules comprise pig iron grade nuggets.

11. The process of claim 10, wherein the hearth is capable of being used more than one time in a traveling hearth furnace for producing pig iron grade nuggets.

12. The process of claim 10, further comprising separating the pig iron phase from the slag phase by one or more of tumbling and/or magnetic separation.

13. The process of claim 10, wherein further comprising lauding the pig iron grade nuggets into rail cars, trucks, barges and/or ships for shipment.

14. The process of claim 11 wherein the synthetic graphite material of the hearth does not need to be replenished for the hearth to be used in more than one cycle within the traveling hearth furnace for producing pig iron grade nuggets.

15. The process of claim 1, wherein the hearth comprises a raised edge to confine the iron and slag in a molten state within the hearth during processing, the raised edge preferably comprising synthetic graphite material.

* * * * *